US006729966B1

(12) United States Patent
Barelli et al.

(10) Patent No.: US 6,729,966 B1
(45) Date of Patent: May 4, 2004

(54) GOLF PRACTICE AID

(76) Inventors: Pete Barelli, 2733 Wishart Dr., Rockford, IL (US) 61114; John Barelli, 5625 Lambeth La., Rockford, IL (US) 61107

( * ) Notice: Subject to any disclaimer, the term of this patent is extended or adjusted under 35 U.S.C. 154(b) by 0 days.

(21) Appl. No.: 09/527,504

(22) Filed: Mar. 16, 2000

(51) Int. Cl.[7] ..... A63B 53/06; A63B 53/16; A63B 69/36; A63B 57/00

(52) U.S. Cl. ..... 473/236; 473/226; 473/251

(58) Field of Search ..... 473/206, 221, 473/226, 236, 242; 273/DIG. 30

(56) References Cited

U.S. PATENT DOCUMENTS

| | | | | | |
|---|---|---|---|---|---|
| 3,021,141 | A | * | 2/1962 | Polsky et al. | 473/236 |
| 3,039,776 | A | * | 6/1962 | Faini | 473/236 |
| 3,194,564 | A | * | 7/1965 | Swan | 473/236 |
| 3,437,341 | A | * | 4/1969 | Hasten, Jr. et al. | 473/236 |
| 3,489,415 | A | * | 1/1970 | Smith | 473/236 |
| 4,025,078 | A | | 5/1977 | Pelz | |
| 4,191,372 | A | * | 3/1980 | Keller | 273/DIG. 30 |
| D256,710 | S | * | 9/1980 | Dusto | D21/759 |
| 4,323,246 | A | * | 4/1982 | Nehrbas, Jr. | 473/236 |
| 5,011,153 | A | | 4/1991 | Watkins | |
| 5,135,228 | A | * | 8/1992 | Hawkins, Sr. et al. | 473/236 |
| 5,135,229 | A | | 8/1992 | Archer | |
| 5,351,961 | A | | 10/1994 | Eulan | |
| 5,441,268 | A | * | 8/1995 | Shier | 473/236 |
| 5,478,078 | A | * | 12/1995 | Lee | 473/236 |
| 5,551,695 | A | * | 9/1996 | Wolk | 473/236 |
| 5,603,665 | A | * | 2/1997 | Bryant | 473/230 |
| 5,810,675 | A | | 9/1998 | Weathers | |
| 5,895,328 | A | * | 4/1999 | Pahio | 473/224 |
| 5,961,392 | A | * | 10/1999 | Hillock et al. | 473/236 |
| 6,233,747 | B1 | * | 5/2001 | Barker | 2/247 |

* cited by examiner

*Primary Examiner*—Gregory Vidovich
*Assistant Examiner*—Alvin A. Hunter, Jr.

(57) ABSTRACT

A pair of error amplification deflectors, releasably attached to the face of a golf club with hook and loop patches, are spaced to provide a central zone on the face of the club for directing a golf ball along a normal path upon squarely striking the ball, but are shaped for redirecting the path of the ball upon striking the ball to provide a signal indicative of an off-center putting stroke or golf swing. The hook and loop patches permit adjustment of the width of the center zone for different levels of practice difficulty, and provide further indication of an off-center stroke by absorbing energy to decelerate the speed of the redirected ball.

18 Claims, 5 Drawing Sheets

GOLF PRACTICE AID

BACKGROUND OF THE INVENTION

1. Field of Invention

The present invention relates generally to accessories for golf clubs. More particularly, the invention relates to a golf practice aid adapted to releasably attach to the face of a conventional golf club to assist a golfer in improving accuracy in consistently striking a golf ball with a desired approach path and at a desired central location on the face of the club.

2. Description of Prior Art

Golf requires precise repeatable motions to strike the golf ball and eventually roll the ball into a cup in the ground. Contacting the ball with precise repeatable motions is one of the most difficult aspects of the game. To that end, many prior golf practice and training aids have attempted to assist golfers achieve this desired consistency when striking the ball.

Many prior golf training aids require clubs or other aids designed specifically for practice sessions. For example, numerous practice clubs and training systems utilize special club or grip configurations to teach correct form and motion for a swing or stroke of the club. Unfortunately, difficulties occur when switching from such special training devices used in practice sessions back to a golfer's regular clubs for regular play such as tournament, competitive or leisure golfing. Often the lessons and skills learned during practice with specialized clubs are lost when returning to the golfer's regular set of clubs due to the differences in weight, club length, club height, grip, shaft stiffness or flexure, and the numerous other club performance and dimensional parameters. Therefore, it is desirable that a training system for improving accuracy of a golfer's swing or putting stoke would utilize the golfer's regular clubs.

In addition, specialized practice clubs require the golfer to purchase the specialized club in addition to a set of regular clubs, and are often relatively expensive. On the other hand, a training system for improving swing or stroke accuracy that utilizes a golfer's regular clubs would eliminate the need to purchase additional clubs, and would result in less expense to the golfer.

A few prior specialized putters attempt to address the problem of purchasing additional putters for training. These specialized putters are adapted for conversion between a training configuration and a regular play configuration. Such arrangements are disclosed in Petz U.S. Pat. No. 4,025,078 and Archer U.S. Pat. 5,135,229. Nevertheless, these arrangements still require the purchase of the specialized clubs. Thus, golfers that already own a set of clubs must still purchase additional clubs for practice.

There are also several prior practice aids adapted to attach to a regular putter for assisting the golfer in improving stroke accuracy. However, these prior arrangements tend to be difficult to attach and detach from the putter, and awkward to use and store between uses. They also tend to be rather bulky and add substantial weight to the putter, thus altering the feel and performance of the putter during practice sessions, and presenting the difficulty of transferring the practiced stroke into regular play when the aids are not attached.

For example, Watkins U.S. Pat. No. 5,011,153 and Eulau U.S. Pat. No 5,351,961 disclose prior golf stroke training devices specific to improving putting accuracy. Watkins discloses a putting aid that comprises a relatively long U-shaped bracket attached to a putter head with a rubber band, with the parallel legs of the bracket forming a guideway for approaching and striking the ball. Eulau discloses an alternate device connected to the front of the club with spaced prongs extending forwardly therefrom to assist the golfer in alignment between the center of the club and the ball. Unfortunately, both of these arrangements are relatively bulky, heavy and awkward to use. Shier U.S. Pat. 5,441,268 requires both straps and loops to secure guiding blocks into position on the face of the putter. None of these prior arrangements provide feedback to the golfer in the event of a mis-hit such as to give an indication of whether the club struck the ball near or relatively far from the center of the putter.

Other types of prior putting training aids are also disclosed in the art. For example, Wolk U.S. Pat. No. 5,551,695 describes an adjustable golf putting system that uses a training track, and a guide which attaches to the head of the putter. Weathers U.S. Pat. No. 5,810,675 concurs that the prior arrangements of earlier patents are awkward to handle and incorporate inadequate attachment. Weathers then discloses a one-piece system with two parallel guide members that incorporate a clamp system such as is designed to fit in the cavity in many modern putters. Nevertheless, the Weathers arrangement is still rather heavy and difficult to use.

In view of the foregoing, it is clear there is a need for a golf training aid for improving ball striking accuracy of a golfer's swing or stroke that (a) utilizes a golfer's regular clubs, thus eliminating the need to purchase additional clubs and resulting in less expense to the golfer, (b) is light weight and easy to attach and detach from the putter, thus maintaining essentially the same weight and feel of the club between practice and regular play, and (c) is unobtrusive and easy to use and store between uses.

SUMMARY OF THE INVENTION

The general aim of the present invention is to provide a new and improved golf practice aid adapted to assist the golfer in improving his or her putting stroke and ball striking accuracy and consistency.

A detailed objective of the invention is to provide a golf practice aid that is adapted for use with a conventional putter, but that does not affect the feel, stroke and ball-striking characteristics of the putter, or the path of a properly hit ball, between practice and regular play. This eliminates the need to purchase specialized clubs, and promotes the carry-through of the stroke learned in training sessions to regular play.

Another detailed objective of the invention is to provide a golf practice aid that is easy to use, unobtrusive during use, and is relatively compact for ease of handling and storage between uses.

A more detailed objective is to achieve the foregoing by providing an aid that is light weight and adapted for ease of attaching to and detaching from the face of a conventional club.

Another detailed objective of the invention is to provide a practice aid that permits striking of a golf ball within a central zone, near the center of percussion, on the face of the putter in a normal manner, but that provides immediate audio-visual feedback to the golfer in the event the club strikes the ball with an improper stroke or outside the central zone to permit appropriate correction during the golfer's next stroke.

A more detailed objective is to achieve the foregoing by providing a golf practice aid adapted for changing the direction and speed of the ball upon striking the ball outside the central zone during practice training.

Another detailed objective of the invention is to provide a golf practice aid that permits progressive training as the accuracy of the golfer's stroke improves.

Yet another objective is to provide such a golf practice aid adapted for use not only with putters, but with other type of golf clubs, for use in developing accurate stroke or swing habits associated with such other clubs.

These and other objectives and advantages of the invention will become more apparent from the following detailed description when taken in conjunction with the accompanying drawings.

Briefly, one preferred embodiment golf practice aid of the present invention includes a pair of light weight error amplification deflectors releasably attached to the face of a putter with complementary, resilient hook and loop patches such as VELCRO brand patches. The error amplification deflectors are sized and spaced on each side of center so that central portion of the putter face is unobstructed for striking the golf ball in the normal manner, but are shaped to deflect the ball in a direction away from its otherwise normal path, and at a reduced speed in the event of impact with the ball to indicate to the golfer that the swing was off-center.

Figure 1:
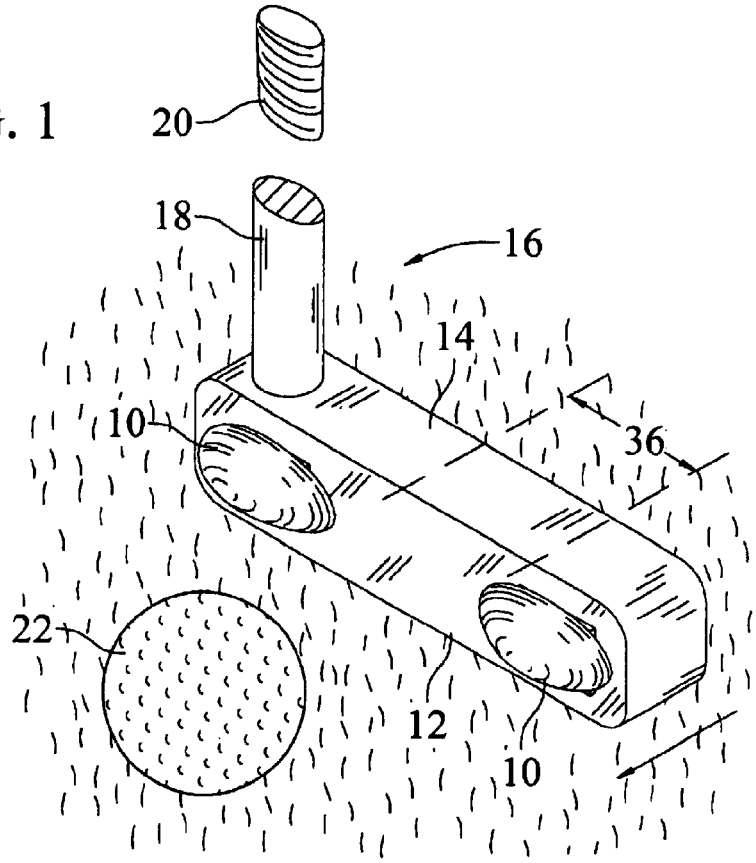
FIG. 1 is a perspective view of a golf ball and a putter onto which a pair of error amplification deflectors according to the present invention are attached.
Figure 3:
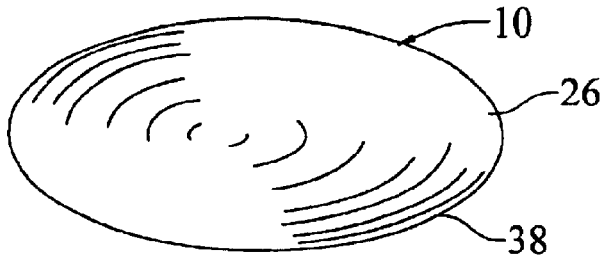
FIG. 3 is a front view of the error amplification deflector shown in FIG. 2.
Figure 2:
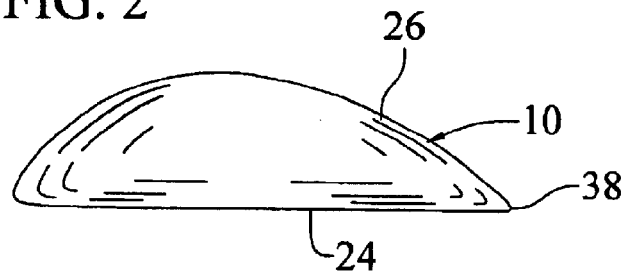
FIG. 2 is a top view of an error amplification deflector shown in FIG. 1.
Figure 4:
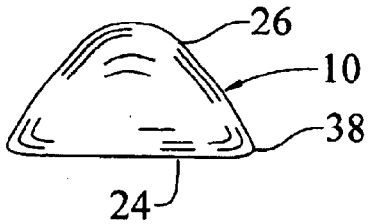
FIG. 4 is a side view of the error amplification deflector shown in FIG. 2.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, one embodiment of the present invention is shown in the drawings as embodied in a pair of error amplification deflectors 10 (FIGS. 1–9) releasably attached to the ball-striking face 12 of a putter head 14. The putter 16 shown is of a conventional type comprising a shaft 18, a grip 20 and the putter head having a vertical face 12. As will become apparent, the present invention is equally suitable for use with a variety of golf club configurations such as irons, wedges, chipping putters with angled faces.

In accordance with the present invention, the error amplification deflectors 10 assist a golfer in improving putting accuracy—by assisting in the development of a consistent, repeatable, centered putting stroke with the proper angle of approach that results in consistent, repeatable contact between the golf ball 22 and a desired central portion of the putter head 14.

Figure 5:
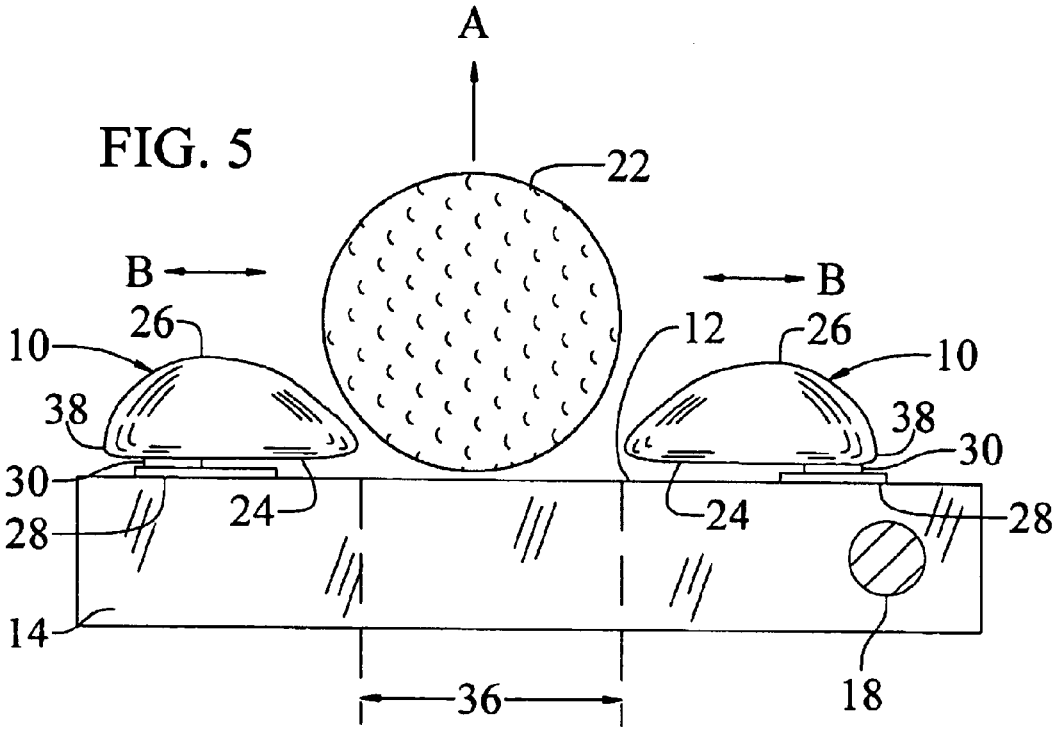
FIG. 5 is a top view of the putter and error amplification deflectors of FIG. 1, with the putter striking a ball in the central zone of the putter face.
Figure 6:
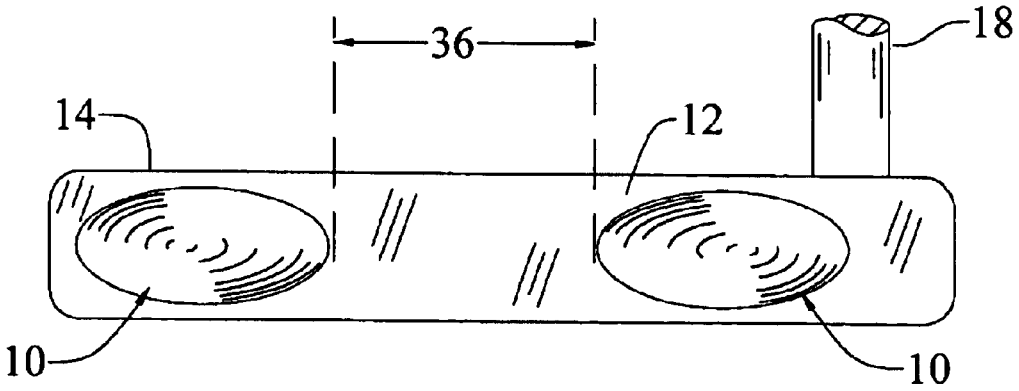
FIG. 6 is a front view of the putter and error amplification deflectors of FIG. 1.
Figure 7:
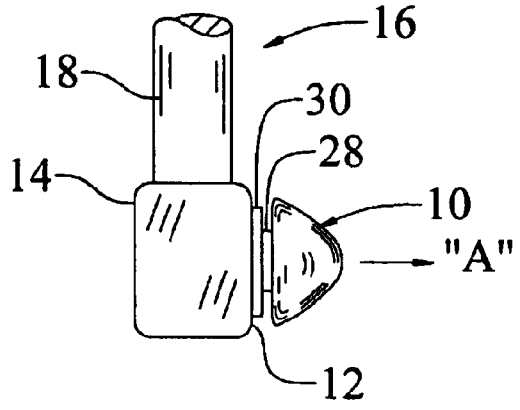
FIG. 7 is a side view of the putter and error amplification deflectors of FIG. 1.
Figure 8:
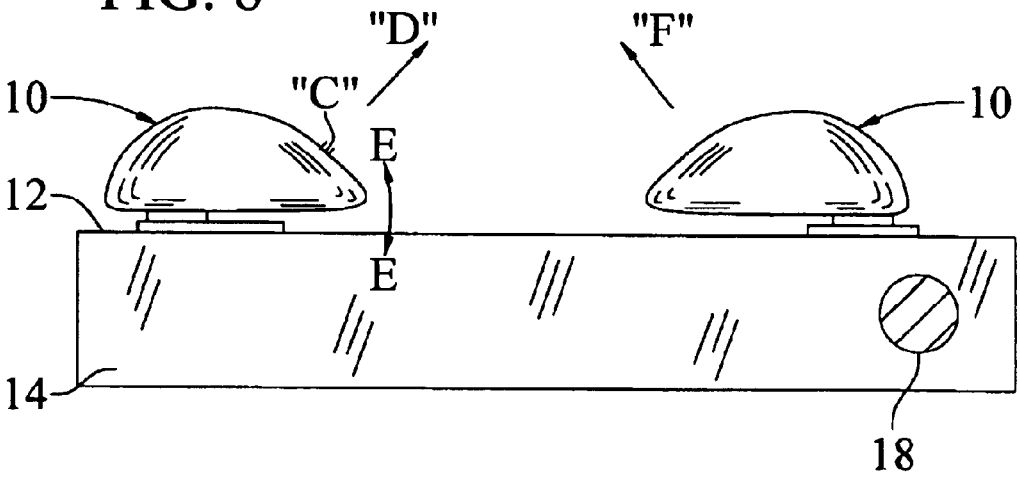
FIG. 8 is a view of the putter similar to FIG. 5 but indicating the paths of a ball if struck by the error amplification deflectors.

Briefly, the error amplification deflectors are spaced on each side of the center of the putter face by a distance greater than the diameter of the ball such as shown in FIG. 5 to define a desired ball-striking central zone portion 36 on the face of the putter. During a practice putting stroke, with the error amplification detectors in place on the putter, if the golfer contacts the ball square and within the central portion 36 of the putter, the resulting path "A" (FIG. 5) of the ball travel is normal to the face of the putter as expected and desired. However, if the putter approaches the ball off-center, the ball contacts and is driven by one of the error amplification deflectors in a direction away from the expected path "A" in a manner that indicates to the golfer that the swing was off-center, and preferably indicating in which direction from center the putter approached the ball. Thus, the error amplification deflectors provide immediate feedback to the golfer on stroke accuracy. This feedback information permits the golfer to adjust the next stroke toward center contact with the ball, thus promoting immediate improvement in putting accuracy.

Each error amplification deflector 10 includes a back side 24, a front side 26, and an outer peripheral portion 38 connecting the front and back sides. The front side is shaped and configured so that it misdirects, i.e., redirects, the path of the golf ball in a predetermined direction away from path "A" upon squarely striking the ball. When in position on the putter, preferably, one error amplification deflector redirects the ball in one direction away from path "A" and the other error amplification deflector redirects the ball in the opposite direction from path "A"

The front side 26 of each error amplification deflector 10 is formed with at least an active inner portion that slopes generally outwardly from an inside edge portion adjacent the center portion 36 of the putter face 12. The error amplification deflectors are relatively small, being preferably sized and shaped to fit within the outer boundaries of the putter face; and preferably formed with a generally smoothed, gently curved or otherwise shaped front side to preclude catching on grass during a putting stroke, thus permitting use in practice areas having different grass lengths.

Preferred error amplification deflectors 10 are also relatively light weight, being made from a light weight, low cost material such as wood or molded plastic, such that they do not substantially alter the combined weight of the putter 16 when attached thereto, and such that the difference in weight is negligible with regard to the golfer's ability to distinguish the presence of the deflectors on the putter. In other words, the weight of the deflectors do not contribute perceptibly to the weight of the putter. For example, it has been found that deflectors of approximately 0.2 to 1.0 ounce are virtually undetectable when placed on conventional putters such as having putter heads of approximately 10–14 ounces. With this arrangement, the error amplification deflectors do not noticeably change the golfer's normal stroke when attached to the putter.

In keeping with the invention, the error amplification deflectors 10 are releasably attached to the putter face 12 with a quick connect-release mechanism. In preferred embodiments, the back side 24 of the deflector substantially conforms to the surface of the putter face 12 to facilitate attachment with quick connect/release complimentary hook and loop patches 28 and 30, respectively, such as VELCRO or other brand hook and loop patches having self-sticking or adhesive backing. In the embodiment shown, the back side of the error amplification deflectors are formed substantially flat for conformance with the substantially flat putter face 12. In carrying out this aspect of the invention, two hook patches 28 are adhered in spaced relation to the front of the putter, and a loop patch is adhered to the back of each deflector. These patches are sized and positioned such that the deflectors are positionable on the putter with an adjustable clearance therebetween for the ball to pass, for defining an adjustable-width central portion 36 on the putter face for striking the ball. As discussed further below, this adjustable-width clearance provides for progressive practice difficulty via multiple positioning of the deflectors, progressively narrowing the clearance and requiring an increasingly precise execution of the stroke during a practice session. Any one of several known alternate methods may be used for connecting the hook and loop patches to the putter face and deflectors, however, most of these methods are more complicated and more expensive.

Advantageously, the compact size and light weight construction of the error amplification deflectors 10 enables them to be easily stored and carried by the golfer such as in a golf bag pocket, and the ease of attachment and release enables them to be quickly installed and removed for practice sessions. As a result, the deflectors may be available and are suitable for use even for short practice sessions during limited time periods such as for warm-up or when waiting for tee-off time.

For reasons discussed further below, the error amplification deflectors 10 are preferably not rigidly connected to the putter face 12, but are instead attached with a pliant or semi-resilient connection such that the deflectors act and react as a mass attached with a mechanically-damped resilient connection. With such arrangement, the inside edge portions of the error amplification deflectors are spaced forwardly from the putter face such that the deflectors will pivot and/or cantilever about the semi-flexible connection when striking the ball. Advantageously, the pliant nature and combined thickness of connected hook and loop patches 28 and 30 provides this semi-resilient pivoting-cantilevering connection.

Those skilled in the art will appreciate that an installation attachment guide jig (not shown) may be provided to assist the golfer in positioning the hook patches 28 on the putter face 12. The jig will be adjustable to assist in finding the center of putters of different lengths, or the preferred contact point on the putter face, and then to assist in positioning the two hook patches a predetermined distance, or within a predetermined range of distances, on each side of the center or preferred contact point on the putter for adherence to the face at the desired locations. Such a jig will consider diameter of the golf ball, the size of the error amplification deflectors, and their possible positioning with respect to the hook patches to establish the adjustable center portion 36 clearances for the ball to pass between when practicing.

Once the hook and loop patches 28, 30 are attached to the putter head 14 and the error amplification deflectors 10, respectively, the deflectors are attached to the putter for practice putting. As mentioned above, the longitudinal spacing of the error amplification deflectors can be adjusted for defining the width of the central portion 36 to the golfer's preferences and skill level. If the golfer repeatedly strikes the ball with the deflectors during practice, the deflectors can be separated to provide additional center zone for striking the ball. Typically, a golfer will initially place the deflectors relatively far apart on the putter. As the golfer's stroke consistency improves, the deflectors can be moved closer together. In this way, the deflectors assist in progressive attenuation of stroke putting error, allowing the golfer to decrease the clearance and increase the difficulty over time, and thus enabling the golfer to enhance putting stroke precision as training increases.

During a practice session, when the golfer executes an accurate putting stroke that clears the spacing between the deflectors 10 and contacts the ball 22 center squarely with the central portion 36 of the putter head 14, the deflectors have no effect on the ball, and the ball will rebound along path "A" as desired, without any change in ball speed or path as compared with being hit by the putter in the center location 36 with the club squared to the ball without the error amplification deflectors on the putter. Thus, accurately striking the ball results in straight linear recoil from the golfer's original putter face, providing for an identical feel regardless of whether practicing with the deflectors or playing without the deflectors. Since the desired target area is exactly the same as when the deflectors are not on the putter, this is a true reproduction of the putter stroke and ball contact recoil expected during regular play due to an exact reproduction of ball to putter face contact during practice, even with the presence of the deflectors. There is no change in putter length or putter contact surface, and a negligible change of mass affecting the moment arm of the putter. The preservation of the putter striking characteristics is key to repeatability and reproduction of the practiced stroke during regular play.

On the other hand, if the golfer errs in his stroke during practice, and approaches the golf ball 22 outside of the central zone 36 of the putter head 14, the ball will contact one of the error amplification deflectors 10, resulting in redirection and deceleration of the ball from the desired path "A". Ball deceleration is generally a result of the mechanically damped, resilient connection of the deflector to the putter head, and the resilient action of the deflector at the point which strikes the ball. Ball redirection results generally from the slope or curvature of the deflector at the point of contact with the ball. If, for example, the ball strikes the error amplification deflector 10 shown at point "C" in FIG. 8, the ball will rebound to the right (as viewed in FIG. 8) and in the direction indicated by arrow "D". Alternately, if the opposite deflector contacts the ball in the same general location the ball will rebound to the left (as viewed in FIG. 8) as indicated by arrow "F". In addition to this visual feedback in the form of ball path redirection and deceleration, the golfer will hear a unique "off center" sound indicator due to the material difference between the putter face and the deflectors and the damped connection therebetween.

Thus, with this arrangement, the deceleration and misdirection of the ball 22, and the difference in sound when striking an error amplification deflector 10, provide immediate auditory and visual feedback to the golfer to indicate an improper putting stroke has occurred. This feedback eliminates the possibility of improper practice putting strokes being repeated under a "false positive" result, and then being integrated into the golfer's regular play. More particularly, this feedback provides the golfer with information as to the required corrective action for the next practice stroke. For example, decelerated redirection of the ball along path "D" indicates to the golfer that outer deflector struck the ball, and the putter should be adjusted outwardly away from the golfer in order to strike the ball in the central zone 36 of the putter. Similarly, striking the ball with the inner error amplification deflector, resulting in decelerated redirection of the ball along path "F" away from the golfer, indicates that the inner deflector struck the ball, and the putter should be adjusted inwardly toward the golfer to correct the error. Alternately, if the ball is hit along a path other than "A" but does not decelerate, the golfer will understand that the center portion 36 of the putter did strike the ball, and that misdirection of the ball was due to the putter face approaching the ball at an angle other than perpendicular to the desired arc or direction of the stroke, i.e., at an angle other than perpendicular to the desired path "A". In such instance, the golfer has either rotated the putter face from the desired orientation upon striking the ball, or has approached the ball from a direction other than along a path coincident with the desired path "A". This immediate and informative feedback indicative of the type of error in the golfer's stroke results in a faster learning curve for implementing the correct stroke. When consistent central zone, square contact (i.e., contact resulting from the putter approaching the ball in a line coincident with the desired path "A" and with the face of the putter perpendicular to "A") is achieved during practice, the practice stroke can then be easily duplicated in regular play because the putter is not noticeably altered by the presence of the deflectors during practice and development of the correct putting stroke, or by the absence of the deflectors during regular play.

After the practice session is over, the error amplification deflectors 10 are removed from the putter, leaving only the hook patches 28 adhered to the the putter face 12. Since the combined weight of the patches and the deflectors is non-detectable by the golfer, the presence of the hook patches alone remaining on the putter will also be non-detectable. Assuming the golfer has developed sufficient skill to consistently strike the golf ball at least within the space between the inside edges of the hook patches, a distance that is greater than the central zone 36 defined during practice, the presence of the patches will have no effect on the performance and stroke characteristics of the putter during regular play. Alternately, due to their relative low cost, the hook patches may be simply removed and discarded at the end of a practice session, returning the putter to its original condition, with new hook patches being attached to the putter prior to the next practice session.

The interplay of several factors determines the exact redirection angle and deceleration of the ball 22 when struck by an error amplification deflector 10. The angle of the deflector at the point of contact with the ball will to a great extent establish the deflection angle of the ball. The recoil response of the deflector upon striking the ball also contributes to the angle of deflection, as well as to deceleration of the ball. This recoil response is a result of a cantilevering or pivoting action of the deflector such as indicated with arrow "E—E" (FIGS. 8 and 9) when it strikes the ball. This action results in movement between a rest position, and a second position resulting from impact with the ball as indicated by dashed lines in FIG. 9; and is a result of (1) the resilient connection between the hook and loop patches 28 and 30; (2) the distance between an effective pivot point in the hook and loop patch connection and the point of contact "C" with the ball—this distance defining the effective lever or moment arm which acts to pivot the deflector when striking the ball; and (3) the offset spacing between (a) the surrounding inner outer edge portion of back side 24 of the deflector adjacent the central zone and (b) the face 12 of the putter—this offset spacing resulting from the connected thickness of the patches, and permitting the inner edge portion of the deflector to pivot toward the putter face. Thus, the cantilever/pivoting action can be adjusted by increasing or decreasing the resiliency of the connection between the hook and loop patches, the length of the deflectors, and the size, thickness and spacing relationships of the patches; and the angle of redirection of the ball can be selected or adjusted between different embodiments by shaping the front side of deflector for desired interaction with the resilient connection and cantilevering action of the deflector.

Figure 9:
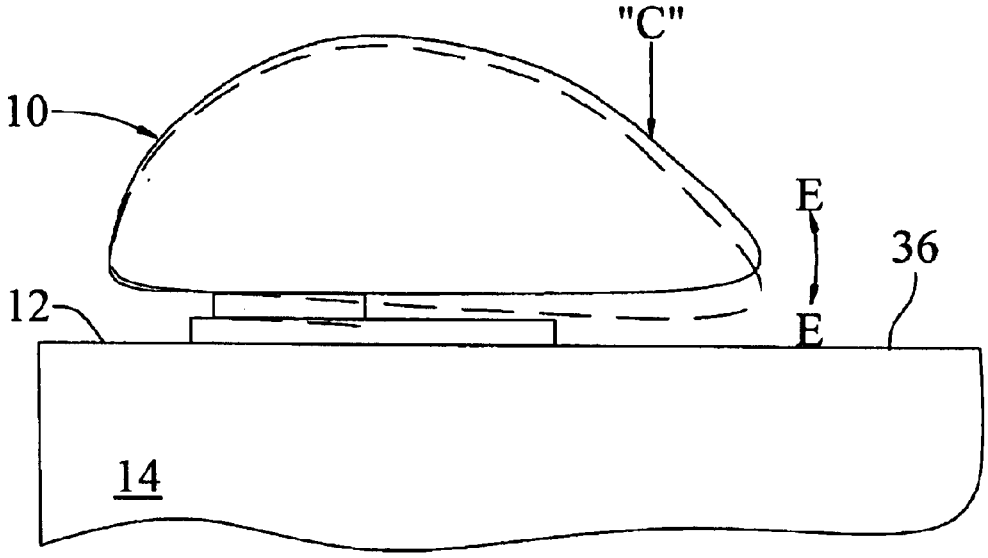
FIG. 9 is a enlarged top view of an error amplification deflector showing movement of the deflector upon striking the golf ball.

Deceleration of the ball 22 is a result of absorption of energy of the momentum in the putter head 14 during the putting stroke by the mechanical damping of the damped resilient/pliant connection between the flexible hook and loop patches 28 and 30 (see FIG. 9). This energy absorption can be adjusted by providing for different connected areas between the hook and loop patches, and by providing patches with different hook and loop thickness, density and resiliency. As will be apparent, the factors affecting energy absorption will also affect the recoil response and redirection of the ball. Thus, the precise redirection and deceleration of the ball for a particular embodiment are a result of selection and interaction of the location and size of the loop patch in relation to the size of the deflector, the size of the loop patch in relation to the size of the hook patch, the connected thickness of the hook and loop patches, and the shape of the deflector.

In alternate embodiments, energy absorption and corresponding recoil deceleration is achieved by either forming the error amplification deflectors 10 from a lightweight, relatively stiff yet energy-absorbing material, or by applying an energy absorbing material such as light-weight rubber coating to either or both the front side 26 and the back side 24 of the deflectors. In such embodiments, the deflectors may be connected to the putter face with either a resilient connection, such as the hook and loop patches 28 and 30, or with a non-resilient, rigid connection such as double-sided tape or other well-known mechanical connecting apparatus.

In either event, the absorption of energy is preferably relatively substantial so as to result in clear visually noticeable deceleration of the ball 22. This visible deceleration enables the golfer to differentiate between redirection of the ball resulting from striking the ball off-center with an error amplification deflector, or striking the ball with the putter face in zone 36 but with either the putter face rotated from tangent to the desired path "A" or the stroke approaching the ball from a direction not coincident with the desired path.

When considering alternate error amplification deflectors, the front side is preferably formed with at least a plurality of arc sections, representing a plurality of curved points that when tangent to the golf ball deflect the ball away from the centerline "A". These tangent points may be discrete break points in the surface created by polygons or other relatively small, discrete surface features, or they may be smoothly curved surface portions such as shown on deflectors 10 in which the front side is formed with a smoothly curved surface presentation, projecting outwardly in a generally convex manner, having a sloped edge portion that curves forwardly from the inside edge portions with respect to the face of the club for deflecting the ball, and generally resembling the shape of an egg split longitudinally.

It is noted that only a limited portion of the front side 26 of error amplification deflector 10 operates as described. Although striking the deflector will result in error deflection and deceleration feedback, only impact with the inner, approximately one-half, portion of each of the deflectors 10 adjacent the central zone 36 (when in place on the putter) will deflect the ball in the manner described such as in directions "D" and "F"; whereas striking the ball with the outer half portion of the deflectors will result in redirection of the ball in the opposite directions by the respective deflectors. However, this is not a drawback in implementing the invention because (1) typical golfers will not have difficulty striking the ball within the distance between the peak centers of the deflectors, and (2) for those few that do, the deflectors may simply be temporarily moved further outwardly, to extend beyond the sides of the putter, until such time as the golfer's putting accuracy improves to move the deflectors back within the boundaries of the putter. With the generally convex, relatively smooth shape, moving the deflectors to extend beyond the sides of the putter will have only minimum affect such when using the deflectors in longer grass, and will have no effect under other conditions, thus realizing all of the other advantages for improving putting accuracy. In addition, with the patches on the deflectors longitudinally off-center as shown, the deflectors can be reversed, by flipping the deflectors 180 degrees and exchanging places between the inside and the outside edge portions, to provide for additional central zone 36 space and/or to obtain different deceleration and redirection characteristics. Other advantages of this embodiment are discussed below.

Figure 11:
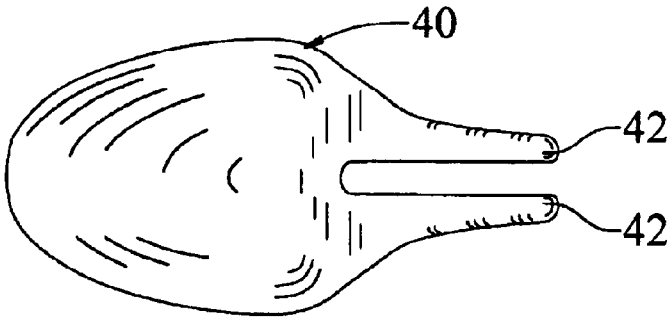
FIG. 11 is a front view of the alternate embodiment error amplification deflector shown in FIG. 10.
Figure 10:
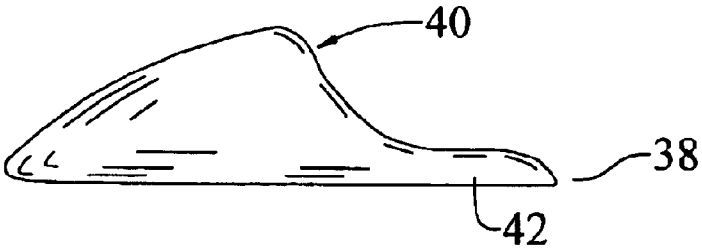
FIG. 10 is a top view of an alternate embodiment error amplification deflector.
Figure 12:
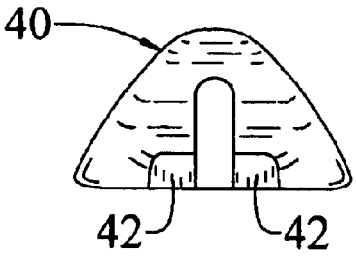
FIG. 12 is a side view of the alternate embodiment error amplification deflector shown in FIG. 10.

In an alternate embodiment shown in FIGS. 10–12, the error amplification deflector 40 is formed similar to deflectors 10, but includes a pair of tines 42 formed extending inwardly from the outside edge portion of the deflector. These tines enable the deflector 40 to function as a divot repair tool when not in place on the putter, and the compact size of the deflector permits the golfer to carry the deflector for repairing ball marks on the green during regular play. In this instance, the times will be positioned extending outwardly away from the central zone 36 when positioned on the putter, i.e., the times will be adjacent the sides of the putter, and will have no effect on the deflection-deceleration performance of the deflector.

Figure 13:
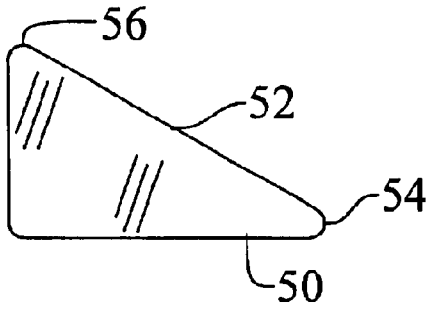
FIG. 13 is a top view of a second alternate error amplification deflector according to the invention.

In another alternate embodiment error amplification deflector 50 shown in FIG. 13, the front side 52 is shaped sloping outwardly along a straight line upon progressing from the inner edge portion 54 to the outer edge portion 56 to define a wedge-shaped deflector. This arrangement provides error feedback to the golfer similar to deflector 10 but over a greater linear distance from the central zone 36 of the putter.

Figure 14:
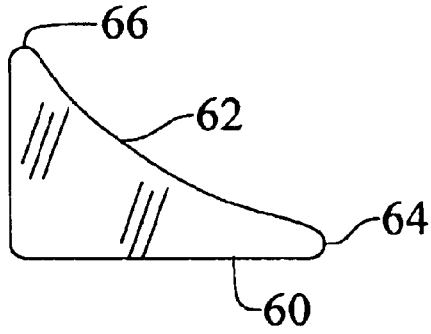
FIG. 14 is a top view of a third alternate error amplification deflector according to the invention.

In yet another alternate embodiment shown in FIG. 14, the front side 62 of the error amplification deflector 60 is formed having a generally concave shape, with an outer edge portion 66, and an inner edge portion that curves forwardly from the inside edge portion 64. This configuration provides for a redirection of the ball along an angle that progressively increases as the distance between the point of contact with the ball and the center of the putter face increases; and is advantageous in that to assist the golfer in determining the extent of adjustment necessary to correct for an off-center stroke for the next practice stroke. In embodiments such as shown in FIGS. 13 and 14, the side and top profiles of the deflectors may be shaped as desired such as with deflector 10, or they may be extended for a constant width along the length of the deflectors.

It will be apparent to those skilled in the art that error amplification deflectors according to the present invention are also suitable for use with a variety of putters and clubs, from flat putters 16 to deeply angled irons, and including pitching wedges; and that suitable error amplification deflectors may be oriented to practice advantage and/or the golfer's preferences for the type of club and practice conditions.

Figure 15:
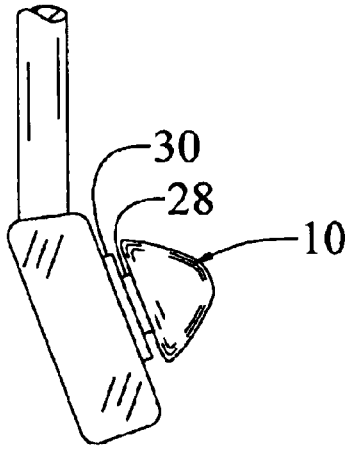
FIG. 15 is a side view of the error amplification deflectors of FIG. 1 is a attached to an alternate golf club.

For example, rectangular hook patches in longitudinal horizontal orientation as previously discussed allow for adjustment of spacing to facilitate a progressive training program with short irons having an angled club face used for short distance chipping such as shown in FIG. 15. It is noted that short irons are the deeply angled clubs such as sand wedges and 7, 8 and 9 irons, while the less angled irons, commonly referred to as long irons, include 3, 4 and 5 irons and less angled for reduced loft and longer shaft for less trajectory and greater distances.

A sand iron (not shown) may utilize vertically spaced hook patches placed along the centerline of the iron to isolate a desired center zone for striking the ball. This orientation allows adjustment in a vertical axis that is usually required for such irons versus the horizontal adjustment suitable for putters.

The hook patches will typically be aligned either horizontally or vertically depending on the club, but they may also be positioned in an offset manner as desired by the golfer such as for use with alternate club designs. In which case, as is the case if used with short irons with a greater club face slope and angles, it is noted that use of shaped error amplification deflectors 10 may result in decelerated redirection of the ball at a compound angle trajectory having an upwardly vertical component if the ball impacts the upper one-half portion of the deflector.

Horizontally spaced error amplification deflectors may also be oriented longitudinally in the vertical axis to match the patches on the iron, or otherwise to accommodate different lengths of grass fringe and rough surrounding the skirt of the green during chipping practice. Advantageously, the egg-shape of error amplification deflectors 10 permit such re-orientation, i.e., rotation of the deflectors 90 degrees from the position shown in FIG. 6, resulting in conversion of the upper-half (or lower-half) portion of the deflector as becoming the inside active portions adjacent the central zone 36.

Deflectors may also be manufactured with other alternate shapes, and alternate front surfaces such as with a texture or dimples. Of course, the same deflectors can be used with different putters and clubs if each is provided with appropriately spaced hook patches.

In connection with use with such other putters and golf clubs, it is also noted that while a stroke is associated with putters, a swing is associated with other types of clubs; and while a ball typically travels along a path on the ground when putting, the travel of a ball associated with the use of other types of clubs may travel with an in-flight trajectory prior to rolling travel on the ground. Thus, it will be understood that the foregoing discussion is applicable to both ball path and putter stroke, as well as ball trajectory and club swing when deflectors are use with other types of clubs.

From the foregoing, it is clear that the present invention brings to the art a new and improved golf practice aid comprising a pair of error amplification deflectors such as deflectors 10, 40, 50 and 60 that (a) releasably attach to the face of a conventional putter or other golf club, thus being suitable for use with a golfer's regular club, and eliminating the need to purchase specialized prior practice putter or other clubs, (b) do not perceptibly alter the weight of the regular golf club, permitting the golfer to switch from practice to regular play while maintaining the skills learned during practice, (c) are compact for ease of handling and storage between practice sessions, (d) are uniquely adapted to provide visual and audio feedback information to the golfer for correcting putting stroke or golf swing, such feedback information being in the form of path redirection and deceleration resulting from a mis-hit, and resulting from a combination of shape and energy absorbing characteristics, (e) while accurately executing a practice swing creates an unobstructed path for a ball and club contact within the desired or targeted hitting zone without altering any pattern of ball recoil, speed, direction or trajectory, and (f) by virtue of preferred associated hook and loop patches 28, 30 (i) provide for a simple, yet durable means for attaching the deflectors to the face 12 of the putter head, (ii) are quickly and easily removable for quick transitioning between practice and regular or tournament play, and (iii) are adjustable to permit progressive levels of practice difficulty as the golfer's swing accuracy improves.

We claim:

1. A golf practice aid for use with a golf club having a head and a face thereon for directing a golf ball along a first path upon squarely striking the ball, the practice aid comprising a first independent error deflector and a second independent error deflector, wherein said first and second error deflectors having a front side, a back side, and laterally spaced inside and outside edge portions;

a first and second connecting means independently attached to the back sides of the first and second error deflectors for independently connecting the first and second error deflectors to the face of the golf club, wherein the inside edge portions of the error deflectors are laterally spaced apart from each other to establish an adjustable central ball-striking zone therebetween and on the face of the club and wherein the front sides of the first and second error deflectors are curved forwardly upon progressing laterally outwardly from the inside edge portions for directing the ball along a path that is not the first path upon striking the ball.

2. The golf practice aid as defined in claim 1 in which said first and second connecting means include a first and second hook patch and a first and second loop patch.

3. The golf practice aid as defined in claim 1 wherein an angle of the path that is not the first path changes as the distance between said central ball-striking zone and point of impact between said first and second error deflectors and the golf ball changes.

4. The golf practice aid as defined in claim 1 wherein the first and second connecting means enable resilient movement of said first and second error deflectors upon impact with the ball, said movement assists in directing the ball along a path that is not the first path.

5. The golf practice aid as defined in claim 4 wherein the first and second connecting means position the inside edge portions of the error deflectors away from the face of the club and are centered about a location behind said first and second error deflectors and enables resilient pivoting of the inside edge portions in a plane generally perpendicular of the face of the golf club.

6. The golf practice aid as defined in claim 5 in which said first and second connecting means include a first and second hook patch and a first and second loop patch.

7. The golf practice aid as defined in claim 1, wherein one of the front and back sides of the first and second error deflectors include a damped means for absorbing said energy upon impact with the ball.

8. The golf practice aid as defined in claim 7, wherein one of the front and backsides of the first and second error deflectors comprises an energy absorbing rubber coating.

9. The golf practice aid as defined in claim 1 in which the front sides of first and second error deflectors are curved forwardly in a generally convex shape from said inside edge portions.

10. The golf practice aid as defined in claim 1 in which the front sides of the first and second error deflectors are curved forwardly in a generally concave shape from said inside edge portions.

11. A golf practice aid for use with a golf club having a head and a face thereon for directing a golf ball along a first path at a first speed upon squarely striking the ball, the practice aid comprising:

a first independent error deflector and a second independent error deflector, wherein said first and second error deflectors having a front side, a back side, and laterally spaced inside and outside edge portions;

a first and second connecting means independently attached to the back sides of the first and second error deflectors for independently connecting the first and second error deflectors to the face of the golf club, wherein the inside edge portions of the error deflectors are laterally spaced apart from each other to establish an adjustable central ball-striking zone therebetween and on the face of the club and wherein the front sides of the first and second error deflectors are curved forwardly upon progressing laterally outwardly from the inside edge portions for directing the ball along a path that is not the first path upon striking the ball and said first and second connecting means include a damped means for absorbing energy upon impact of said first and second error deflectors with the ball for driving the ball along a path that is not the first path at a second speed less that said first speed.

12. The golf practice aid as defined in claim 11 in which said first and second connecting means include a first and second hook patch and a first and second loop patch.

13. The golf practice aid as defined in claim 11 in which the front sides of the first and second error deflectors are curved forwardly in a generally convex shape from said inside edge portions.

14. The golf practice aid as defined in claim 11 in which the front sides of the first and second error deflectors are curved forwardly in a generally concave shape from the inside edge portions.

15. A golf practice aid for use with a golf club having a head and a face thereon for directing a golf ball along a first path upon squarely striking the ball, the practice aid comprising:

a first independent error deflector and a second independent error deflector, wherein said first and second error deflectors having a front side, a back side, and laterally spaced inside and outside edge portions;

a first and second hook patch and a first and second loop patch wherein one of the first hook patch and the first loop patch is independently attached to the back side of the first error deflectors and face of golf club, and one of the second hook patch and the second loop patch is independently attached to the back side of the second error deflectors and face of golf club for independently connecting the first and second error deflectors to the face of the golf club, wherein the inside edge portions of the error deflectors are laterally spaced apart from each other to establish an adjustable central ball-striking zone therebetween and on the face of the club and the front sides of the first and second error deflectors are curved forwardly upon progressing laterally outwardly from the inside edge portions for directing the ball along a path that is not the first path upon striking the ball and the first and second error deflectors are operative to provide a signal indicative of a location of impact with the ball in assisting a golfer in improving accuracy of striking the ball within the central ball-striking zone.

16. The golf practice aid as defined in claim 15, wherein the front sides of the first and second error deflectors are curved forwardly upon progressing laterally outwardly from the inside edge portions for directing the ball along a path that is not the first path upon striking the ball and to provide a signal indicative of impact with the ball.

17. The golf practice aid as defined in claim 15 in which the front sides of the first and second error deflectors are curved forwardly in a generally convex shape from said inside edge portions.

18. The golf practice aid as defined in claim 15 in which the front sides of the first and second error deflectors are curved forwardly in a generally concave shape from said inside edge portions.

* * * * *